United States Patent [19]

Sanada

[11] 4,341,479

[45] Jul. 27, 1982

[54] TYPEWRITER RIBBON CARTRIDGE ACTUATING DEVICE FOR PORTABLE TYPEWRITER

[75] Inventor: Kokichi Sanada, Tokyo, Japan

[73] Assignee: Fuji Seiko Kabushiki Kaisha, Tokyo, Japan

[21] Appl. No.: 187,981

[22] Filed: Sep. 16, 1980

[51] Int. Cl.[3] ..... B41J 32/02; B41J 33/26

[52] U.S. Cl. ..... 400/208; 400/216.3; 400/216.6; 400/235.1

[58] Field of Search ..... 400/208, 211, 216.3, 400/697.1, 216.6, 235, 235.1

[56] References Cited

U.S. PATENT DOCUMENTS

| | | | |
|---|---|---|---|
| 938,562 | 11/1909 | Felkel | 400/216.3 |
| 1,807,590 | 6/1931 | Ely et al. | 400/216.6 |
| 3,897,467 | 8/1975 | Shattuck et al. | 400/208 |
| 3,897,866 | 8/1975 | Mueller | 400/248 |
| 3,927,747 | 12/1975 | Wolowitz | 400/248 |
| 3,980,171 | 9/1976 | Frechette | 400/216.3 |
| 4,243,333 | 1/1981 | Bradshaw et al. | 400/208 |

FOREIGN PATENT DOCUMENTS

| | | | |
|---|---|---|---|
| 1813193 | 8/1970 | Fed. Rep. of Germany | 400/208 |
| 2329446 | 5/1977 | France | 400/208 |

*Primary Examiner*—William Pieprz

*Attorney, Agent, or Firm*—Lowe, King, Price & Becker

[57] ABSTRACT

A portable typewriter particularly adapted for juvenile use comprises a plurality of types, a plurality of key levers each of which has a key and arm, an universal plate actuated by any one of the poeration key levers, a carriage in which a platen is provided for supporting paper, a ribbon cartridge in which a typewriter ribbon is loaded, and ribbon cartridge actuating means connected to the universal plate and adapted to shift the typewriter ribbon cartridge in a direction parallel to the axis of the platen to a typing position and, at the same time, to advance the typewriter ribbon when one of the keys is operated. The cartridge actuating mechanism is arranged to be shiftable vertically independently of its movement parallel to the axis of the platen. The typewriter ribbon cartridge and the actuating means are adapted to easy manufacture, and to allow the extensive use of plastics in the construction.

8 Claims, 8 Drawing Figures

TYPEWRITER RIBBON CARTRIDGE ACTUATING DEVICE FOR PORTABLE TYPEWRITER

BACKGROUND OF THE INVENTION

This invention relates generally to a typewriter and is more specifically directed to a typewriter having a cartridge type ribbon system, which may be simply and inexpensively fabricated and is particularly adapted to juvenile use.

Conventionally, a typewriter ribbon of a spool winding type requires two sets of ribbon winding mechanisms and ribbon guide levers. To replace the used typewriter ribbon, the used ribbon is wound up on one of the spools. After removing the spool holding the ribbon, a new ribbon spool is fitted, one end of the new ribbon is connected to the empty spool at the opposite side, and then the new ribbon is positioned around the guide levers and a ribbon holder. Accordingly, this is a great inconvenience to juvenile users and beginners. These conventional ribbon mechanisms are relatively complicated, and frequently give rise to problems. Additionally, since two sets of ribbon winding mechanisms are required, the number of parts and weight cannot be reduced.

In recent years, several types of typewriter ribbon cartridge have been employed in electric typewriters and office typewriters. However, such cartridge systems are generally too expensive for everyday use by juvenile users and beginners.

SUMMARY OF THE INVENTION

Therefore, it is an object of the present invention to provide a portable typewriter which may be inexpensively fabricated and is suitable for juvenile use, which uses a cartridge ribbon system.

Another object of the present invention is to provide an improved actuating mechanism for shifting a typewriter ribbon cartridge to a typing position and for advancing the ribbon loaded in the cartridge.

According to the present invention, a typewriter ribbon system for a typewriter adapted for juvenile use comprises a cartridge having driving means for advancing a ribbon in the loaded cartridge and a cartridge actuating mechanism adapted to operate whenever a character is typed, wherein the cartridge actuating mechanism is adapted to move the cartridge in a direction parallel to the axis of a platen of the typewriter and advance the ribbon within the cartridge. The cartridge actuating mechanism is arranged to be slidable vertically independently of its movement parallel to the axis of the platen.

BRIEF DESCRIPTION OF THE DRAWINGS

The present invention will become more fully understood from the detailed description given below, and the accompanying drawings of a preferred embodiment of the present invention, which, however, are not to be taken as limitative of the present invention in any way, but are for the purpose of elucidation and explanation only.

DESCRIPTION OF THE PREFERRED EMBODIMENTS

Figure 1:
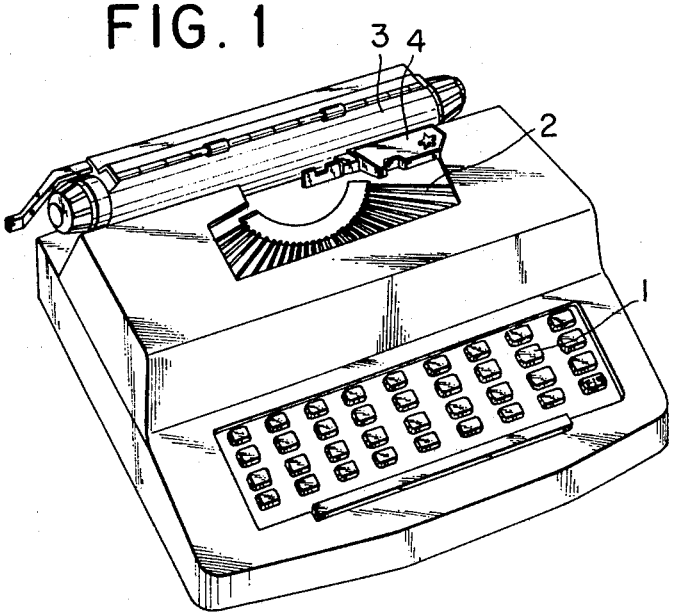
FIG. 1 is an overall perspective view of a typewriter constructed in accordance with the present invention.

Referring now to the drawings, and particularly to FIG. 1, there is illustrated a portable typewriter constructed in accordance with the present invention. In the figure, the numeral 1 designates keys for actuating type levers 2. The numeral 3 designates a platen for supporting paper. The numeral 4 designates a typewriter ribbon cartridge.

Figure 2:
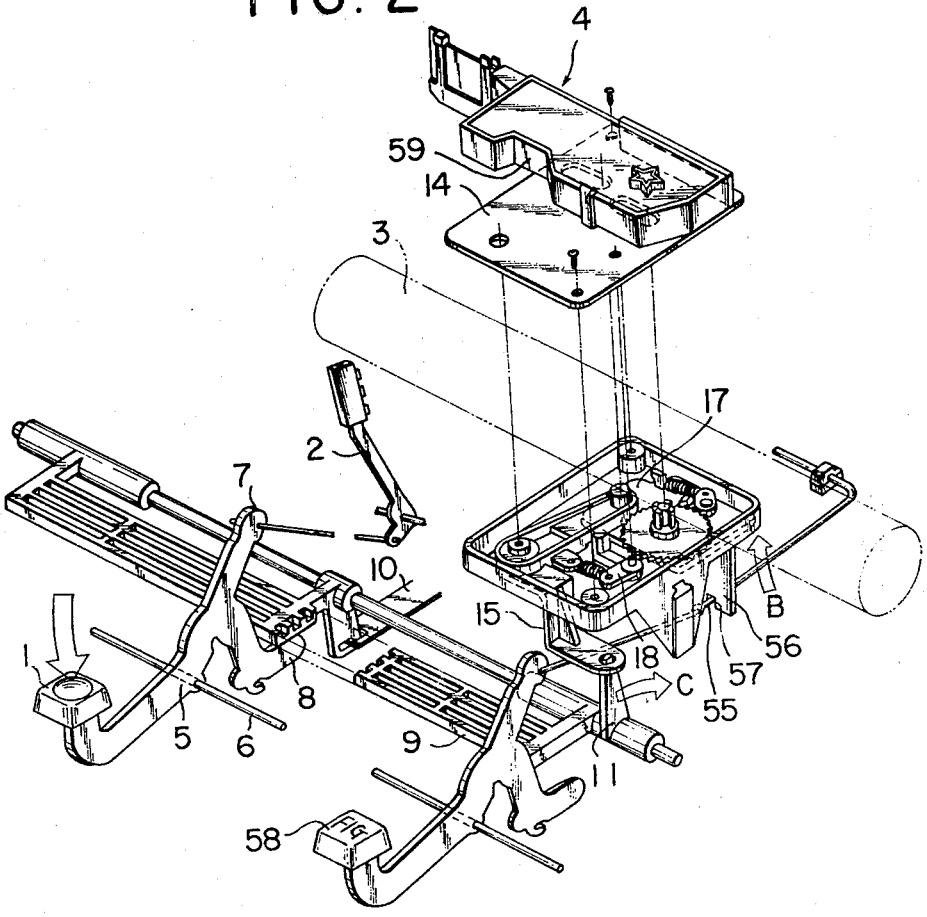
FIG. 2 is a perspective view of a preferred embodiment of a typewriter ribbon cartridge, and actuating means for shifting the cartridge and advancing the typewriter ribbon loaded in the cartridge and for shifting the cartridge vertically to type in a third shift.

FIG. 2 shows a preferred embodiment of an actuating means for actuating the ribbon cartridge 4. In this figure, a key 1 is secured to one end of a key lever 5 which is supported pivotably by a key lever shaft 6. The other end of the key lever 5 comprises an upper arm 7 connected to a type lever 2 through a linkage and a lower arm 8 which contacts the underneath of universal plate 9. The universal plate 9 is supported rotatably and connected to a connecting strip 10 for shifting the platen 3 one space. The universal plate 9 is further provided with an arm 11 at the right end thereof. The top end of the arm 11 is connected to an actuating means indicated generally by numeral 12.

The typewriter illustrated is of a three-shift type in which shifting between upper and lower case letters is achieved in a per se well known method by raising and lowering the type levers, and shifting to the third shift, which includes numerals and symbols, is achieved again in a per se well known method by raising and lowering the platen. Thus when the typewriter is put into the third shift, it is necessary to raise the ribbon by an amount equal to the amount by which the platen is raised.

As seen in FIG. 2, a leg 56 is provided projecting downward from the actuating means 12, and a recess 57 is formed in the lower end thereof. This recess 57 engages with a link 55 forming part of the operating linkage connecting a FIG. shift key 58 for putting the typewriter into the third shift to a mechanism for raising the platen, which is illustrated separately in FIG. 4. It will be seen from FIG. 4 that this platen raising mechanism consists principally of a sliding shift bar 61 which raises the platen and to which the linkage is connected.

Although not specifically illustrated in the drawings, means is provided for supporting the actuating means 12 so that the actuating means 12 is free to slide bodily up and down.

It will be seen that the ribbon cartridge 4 according to the present invention is of a particularly convenient form, having a notch 59 formed in one sidewall, thus making the cartridge particularly easy for a user, and of course especially for a juvenile user, to pick out the cartridge in order to replace it.

Figure 3:
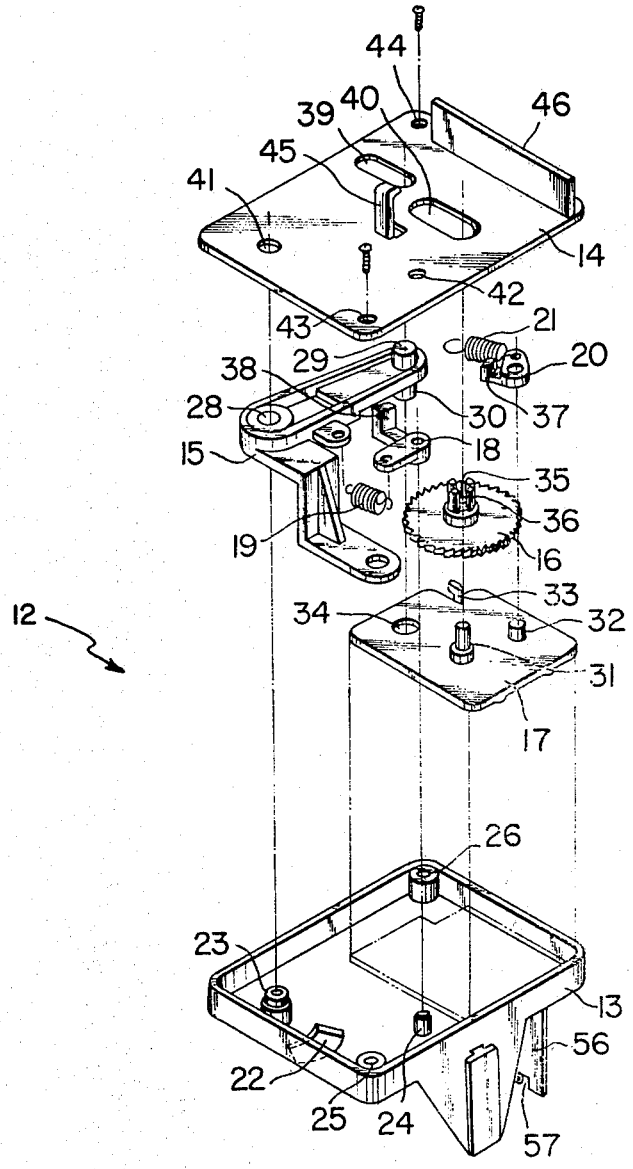
FIG. 3 is an exploded perspective view of the actuating means of FIG. 2.

FIG. 3 shows an exploded view of the actuating means 12, which comprises a base 13, a cover plate 14, an actuating crank 15, a ratchet gear 16, a gear base plate 17, a gear actuating crank 18, a gear stopper 20 and another coil spring 21. The base 13 is provided with a fan-shaped opening 22, a stepped post 23 for rotatably supporting the actuating crank 15, a supporting post 24 for rotatably supporting the gear actuating crank 18, and two holes 25 and 26 for receiving screws fixing the cover plate 14. One end of the actuating crank 15 is passed through the fan-shaped opening 22 and is linked to the top end of the arm 11. A through hole 28 in the actuating crank 15 is mounted on the stepped post 23 so as to be capable of rotating. An upper projection 29 and a lower projection 30 are formed at the other end of the actuating crank 15. The gear base plate 17 is mounted slidably on the base 13. On the gear base plate 17, there is provided a stepped post 31 for supporting the ratchet gear 16, another post 32 for supporting the gear stopper 20 and a hook 33 for connecting to the coil spring 21. Further, a through hole 34 is formed in the gear base plate 17 so as to engage with the lower projection 30 of the actuating crank 15. A through hole 35 is formed at the center of the ratchet gear 16 and engaging keys 36 are integrally formed around the through hole 35. The ratchet gear 16 is mounted on the stepped post 31 so as to be rotatable. The gear stopper 20 is biased by the coil spring 21 so that a pawl 37 of the gear stopper 20 is engaged with the ratchet gear 16 so as to limit the rotation of the ratchet gear 16. The gear actuating crank 18 has a pawl 38 which engages with the ratchet gear 16 and is biased by the coil spring 19 connected between the actuating crank 15 and one end of the gear actuating crank 18.

The cover plate 14 is provided with two through slots 39 and 40, four through holes 41, 42, 43 and 44, a cartridge holder 45 for receiving the cartridge 4, and a cartridge retainer 46 for holding in cooperation with the cartridge holder 45 as shown in FIG. 2. The cover plate 14 is mounted on the base 13 and secured by screws through the through holes 43 and 44 so that the through hole 41 engages with the stepped post 23 which supports the actuating crank 15 and the through hole 42 engages with the supporting post 24 which supports the gear actuating crank 18. Thereby, the upper projection 29 projects through the slot 39 in which it is a loose fit, and the engaging pegs 36 project through the slot 40 in which they are also a loose fit.

Figure 4:
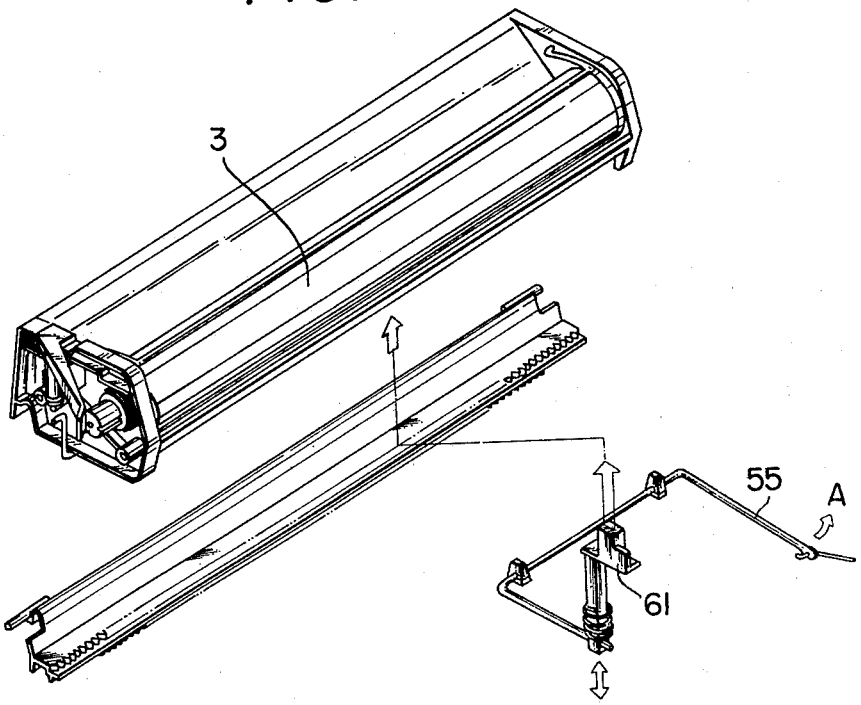
FIG. 4 is an exploded perspective view of an independent actuating means for shifting a platen to a third shift.

FIG. 4 shows an independent actuating means for shifting the platen 3 to a third shift. Namely, when FIG. shift key 58 is pushed, a wire which is connected with the slide shift-bar 61 rotate in the direction of arrow B, thereby the base container 13 is shifted to upper position of the corresponding height with the platen 3 which is shifted at the same time.

Figure 5:
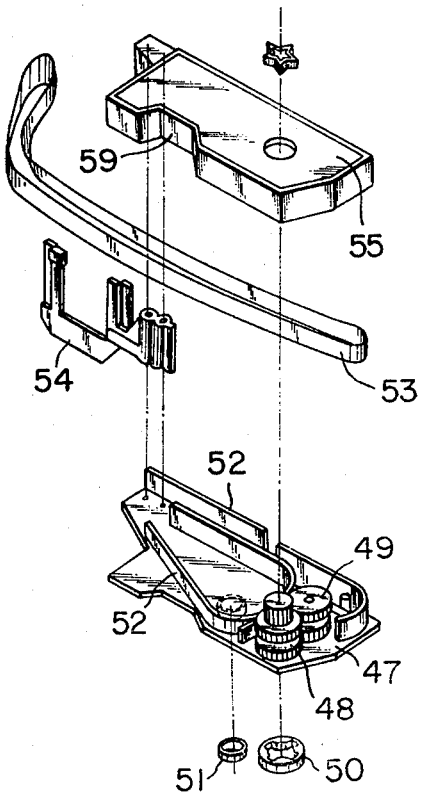
FIG. 5 is an exploded perspective view of a ribbon cartridge which is adapted to cooperate with actuating means of FIG. 2.

One preferred embodiment of a ribbon cartridge which is suitable for the actuating mechanism according to the invention is shown in FIG. 5. In the figure, the numeral 47 designates a cartridge base plate, on which a driving roller 48 and a pinch roller 49 is provided with a slotted sleeve 50 for engaging with the pegs 36 so that the driving roller 48 is rotated by the ratchet gear 16. The outer surface of the cartridge base plate 47 is provided with a sleeve 51 for engaging with the upper projection 29 of the actuating crank 15.

Guide plates 52 are provided on the base plate 47 so as to guide an endless typewriter ribbon 53. A ribbon holder 54 is provided with two holes at the right end thereof so as to engage with two small projections formed at the left end of the base plate 47 and a cartridge cover 55.

Figure 6:
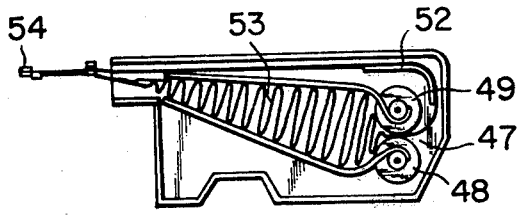
FIG. 6 is a sectional plan view of the ribbon cartridge of FIG. 5.

FIG. 6 shows a sectional plan view of the cartridge in which the ribbon 53 is loaded. The ribbon 53 is advanced into the space enclosed by the guide plates 52 by rotation of the driving roller 48, and at the same time, the driving roller 48 draws the ribbon 53 from the ribbon holder 54. Thereby, the ribbon 53 is moved circularly in the clockwise direction between the ribbon holder 54 and the driving roller 48. The pinch roller 49 presses the ribbon 53 against the driving roller 48 so that the ribbon is fed positively. After setting the ribbon 53 on the cartridge base plate 47, the cover 55 is mounted on the base plate 47. A knob protrudes from a through hole of the cover 55 so that the driving roller 48 can be turned manually.

Figure 7:
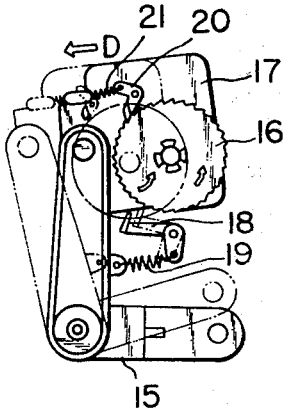
FIG. 7 is a partial view of the actuating means of FIG. 2 showing its actuation.

In FIG. 2, when a key 1 is pressed down, the lower arm 8 is moved upward thereby rotating the universal plate 9. The arm 11 is moved in the direction C, so that the actuating crank 15 is actuated as shown by phantom lines in FIG. 7. By actuating the crank 15, the gear base plate 17 and the ribbon cartridge 4 are slid in the direction of arrow D. Since the ratchet gear 16 is mounted on the base plate 17, the ratchet gear 16 is also moved in the same direction and engages with the pawl of the gear actuating crank 18 connected to the actuating crank 15 through the coil spring 19. Thereby, the ratchet gear 16 is rotated counter-clockwise by a certain angle. Since the pegs 36 of the ratchet gear 16 are engaged with the slotted sleeve 50 of the driving roller 48 in the ribbon cartridge 4, the driving roller 48 is rotated so as to advance the ribbon 53. Further, rotation in the opposite direction is prevented by the gear stopper 20.

Accordingly, the typewriter ribbon cartridge 4 is moved slidingly in the direction of arrow D to a typing position with a simultaneous advance of the typewriter ribbon 53 so that a character can be typed on the paper supported on the platen 3 by the type 2. After typing, the cartridge 4 is returned to its normal position, so that the character typed on the paper can be seen by the operator.

Figure 8:
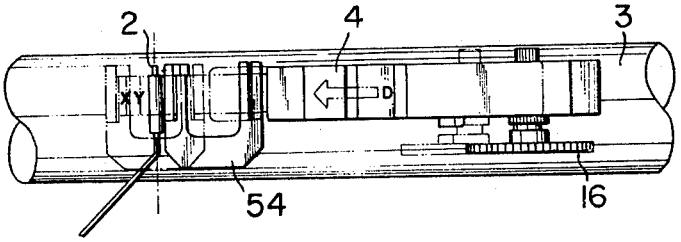
FIG. 8 is a view of the typewriter ribbon cartridge showing how it is shifted into the position for typing.

In FIG. 8, the phantom lines show the cartridge 4 shifted into the typing position.

The parts of the typewriter ribbon cartridge 4 other than the ribbon 53 can all be made of plastic. Further, the actuating means 12 is also formed of component parts made of plastic except for the coil springs 19 and 21, and screws.

From the foregoing, it will be seen that the present invention provides a simple and compact typewriter ribbon cartridge actuating device. That is, since the cartridge comprises a relatively small number of parts of simple structure, it can be fabricated inexpensively. Further, since the actuating device is so designed that the typewriter ribbon cartridge is shifted smoothly in the direction parallel to the axis of the platen, the actuating device of the present invention does not require many parts in comparison with other shifting methods in which the ribbon cartridge is shifted up to the typing position. Furthermore, since the action of shifting the ribbon cartridge into the typing position is directly used to advance the ribbon, it will be seen that this configuration provides a synergistic combination of functions such that the reduction in the number of parts is substantially more that might be obtained by obvious and straightforward adaptions of conventional ribbon shifting and ribbon advancing functions.

Accordingly, the present invention can provide an improved and inexpensive typewriter ribbon cartridge actuating device.

Although the present invention has been shown and described in terms of the preferred embodiment, it should not be considered as limited to this, however, or mere and simple generalizations, or other detailed modifications. Further variations to any particular embodiment could be made without departing from the scope of the present invention, which it is therefore desired should be delimited and defined not by any of the perhaps purely fortuitous details of the shown embodiments, or of the drawings, but solely by the accompanying claims.

What is claimed is:

1. In a typewriter, a device for actuating a ribbon cartridge whenever a typewriter key lever is depressed, said device including actuating means for simultaneously moving the cartridge parallel to the longitudinal axis of a platen of the typewriter into a print position while advancing the ribbon within the cartridge, said device comprising:

(a) a base formed with an opening;

(b) a sliding plate slidably mounted on said base;

(c) an actuating crank pivotably mounted on said base, one end of said crank being connected to a universal plate through said opening in said base and an opposite end of said crank engaging the sliding plate, actuation of the key lever causing movement of the universal plate and pivotal movement of the crank to move the sliding plate and cartridge into print position;

(d) a ratchet gear rotatably mounted on said sliding plate, said gear including advancing means for advancing the ribbon;

(e) a gear actuating crank pivotably secured on the base, said gear crank including a first end engageable with said ratchet gear and a second end connected to the actuating crank;

(f) gear stopper means pivotably secured on the sliding plate for preventing reverse rotation of the ratchet; and (g) a cover plate including holding means for slidably retaining the cartridge on the plate, said cover plate having a first opening receiving the opposite end of the actuating crank engageable with the cartridge and a second opening receiving said advancing means of the ratchet gear, whereby said first and second openings enable sliding movement of the cartridge on the cover plate during sliding movement of the sliding plate.

2. A device according to claim 1, wherein said base further includes means for lifting said device independently of longitudinal movement of the device substantially parallel to the platen, said lifting means being actuated by a shifting mechanism of the typewriter to raise and lower the platen in a shifting movement for selectively printing numerals, symbols and the like carried by a single type lever of said typewriter.

3. A device according to claim 1, wherein said sliding plate includes a stepped post adapted to receive said ratchet gear, a post adapted to receive said gear stopper means, a through hole receiving the opposite end of the actuating crank and a hook connected to the gear stopper means.

4. A device according to claim 1, wherein the first end of the gear actuating crank includes a pawl engageable with said ratchet gear and the second end is interconnected to the actuating crank with spring means.

5. A device according to claim 1, wherein said gear stopper means includes a pawl engageable with said ratchet gear and spring means interconnecting the stopper means and a hook provided on the sliding plate.

6. A device according to claim 3, wherein said opposite end of the actuating crank includes a lower projection engageable with the through hole of said sliding plate.

7. A device according to claim 6, wherein said opposite end of the actuating crank includes an upper projection engageable with a recess in the cartridge.

8. A device according to claim 1, wherein said device is constructed substantially entirely of plastic.

* * * * *